US005766684A

United States Patent [19]

Shah et al.

[11] Patent Number: 5,766,684

[45] Date of Patent: Jun. 16, 1998

[54] STAINLESS STEEL ACID TREATMENT

[75] Inventors: Sadiq Shah, St. Louis; Fred Kirchner, St. Charles, both of Mo.

[73] Assignee: Calgon Vestal, Inc., Mentor, Ohio

[21] Appl. No.: 843,727

[22] Filed: Apr. 21, 1997

Related U.S. Application Data

[63] Continuation of Ser. No. 569,052, Dec. 8, 1995, abandoned, which is a continuation of Ser. No. 311,808, Sep. 26, 1994, abandoned.

[51] Int. Cl.[6] ..... B05D 3/00

[52] U.S. Cl. ..... 427/299; 427/309; 427/327; 427/443.2

[58] Field of Search ..... 427/299, 443.2, 427/309, 327

[56] References Cited

U.S. PATENT DOCUMENTS

| | | | |
|---|---|---|---|
| 3,072,502 | 1/1963 | Alfano | 134/3 |
| 3,154,438 | 10/1964 | Keller et al. | 148/6.15 |
| 3,368,913 | 2/1968 | Ziehr et al. | 117/53 |
| 3,519,458 | 7/1970 | Rausch | 117/6 |
| 4,010,085 | 3/1977 | Carlin | 204/128 |
| 4,045,253 | 8/1977 | Banks | 148/6.14 R |
| 4,104,303 | 8/1978 | Anderson et al. | 252/148 |
| 4,131,519 | 12/1978 | Martinsons et al. | 204/38 B |
| 4,148,707 | 4/1979 | Mayer et al. | 204/207 W |
| 4,590,100 | 5/1986 | Hearst | 427/327 |
| 4,810,405 | 3/1989 | Waller et al. | 252/81 |
| 5,015,298 | 5/1991 | Arrington | 134/2 |
| 5,039,349 | 8/1991 | Schoeppel | 134/26 |
| 5,252,363 | 10/1993 | Anderson | 427/386 |
| 5,321,061 | 6/1994 | Anderson | 523/402 |
| 5,407,597 | 4/1995 | Busch et al. | 252/389.23 |

*Primary Examiner*—Benjamin Utech

*Attorney, Agent, or Firm*—Fay, Sharpe, Beall, Fagan, Minnich & McKee

[57] ABSTRACT

The invention includes a method for cleaning and passivating a stainless steel surface comprising:

1) contacting the surface with 1548 ml/liter of an acid formulation comprising between about 1 and 60% acid component, about 1–15% surfactant, and between about 39 and 98% water;

2) maintaining contact to dislodge and remove residue from the surface;

3) continuing contact to complex free iron ions liberated from the surface to form an oxide film on the surface; and 4) continuing contact to precipitate the complexed ions into the oxide film.

9 Claims, No Drawings

STAINLESS STEEL ACID TREATMENT

This is a continuation of U.S. application Ser. No. 08/569,052, filed Dec. 8, 1995, now abandoned, which, in turn, is a continuation of U.S. application Ser. No. 08/311,808, filed Sep. 26, 1994 now abandoned.

BACKGROUND OF THE INVENTION

The present invention relates to compositions and methods for cleaning and passivating stainless steel surfaces, such as gas flow equipment, pharmaceutical manufacturing equipment, and semiconductor processing equipment.

During the past fifteen years the requirements for cleanliness in semiconductor processing equipment have increased at least a hundred times. Semiconductor feature sizes have been cut in half in the past few years and packing densities have doubled or tripled in the same time period. It also appears that the rate of change is accelerating rather than holding at past rates. With these changes, the problems caused by contamination in semiconductor processing become even more serious. Cleanliness is also important in the health and pharmaceutical industries, driven by the need to reduce the contamination of treatment processes.

In the past, stainless steel equipment used in these processes have been cleaned almost universally by use of solvents. In addition to the problems of atmospheric pollution and operator health hazards, solvents do not clean absolutely. They leave films and particle residuals. Ultrasonic cleaning may also drive particles into crevices in instrument parts, for a later release. Chlorofluorocarbon cleaning solvents sold under the trademark Freon are examples of known cleaning solvents as well as 1,1,1-trichloroethane and methylene chloride.

The lack of cleanliness of the components cleaned by conventional solvents, methods and apparatus is problematical where active ions and organic contamination such as organic films remain on the components. Active ions, e.g. metallic ions, can adversely affect the process in which the equipment is to be used.

Passivation of cleaned steel surfaces is important for preventing conditions such as flash rusting of cleaned wet steel.

In the prior art, cleaned steel is often passivated by treating with an nitric acid solution to provide altered surface characteristics that resist rusting. Dilute solutions of citric acid made alkaline with ammonia or with an amine have been used for passivation of cleaned steel surfaces. These same solutions also have been used in combination with sodium nitrite.

Water-soluble amines are sometimes added to latex or water-dispersed coatings for steel to reduce corrosion. Water-soluble amines also have been added to final rinses for cleaned steel, but always in combination with other materials (such as other alkaline chemicals, citric acid, sodium nitrite, etc., and as exemplified in U.S. Pat. Nos. 3,072,502; 3,154,438; 3,368,913; 3,519,458; and 4,045,253) and therefore these rinses have left insoluble residues on the steel surfaces that are detrimental to optimum performance of subsequently applied protective coatings.

In the prior art, cleaned steel is often passivated by treating with an alkaline sodium nitrite solution to provide altered surface characteristics that resist rusting.

Dilute solutions of citric acid made alkaline with ammonia or with an amine have been used for passivation of cleaned steel surfaces. These same solutions also have been used in combination with sodium nitrite.

U.S. Pat. No. 4,590,100 describes a process that allows previously cleaned steel to be passivated with a rinse of almost pure water, that is made slightly alkaline with an amine to inhibit corrosion preparatory to application of non-aqueous protective coatings, such that any small amine residue remaining on the steel surface after drying of the water will itself evaporate and in such a manner that any remaining amine residue will be incorporated into the non-aqueous protective coating without leaving any water-soluble or ionic residue on the surface of the steel.

U.S. Pat. Nos. 5,252,363 and 5,321,061 describe aqueous organic resin-containing compositions which are useful for depositing coatings on freshly galvanized metals to protect the metals against white rust and provide a surface which is universally paintable. The organic resin consists essentially of at least one water-dispersible or emusifiable epoxy resin or a mixture of resins containing at least one water-dispersible or emulsifiable epoxy resin.

U.S. Pat. No. 5,039,349 describes a method and apparatus for cleaning surfaces, such as semiconductor processing equipment and pharmaceutical processing equipment, to absolute or near-absolute cleanliness involving spraying jets of heated cleaning solution so that it flows over and scrubs the surfaces to be cleaned, producing a rinse liquid. The rinse liquid is filtered and recirculated over the surface to be cleaned.

It is a purpose of the present invention to provide acid-based formulations which both clean and passivate stainless steel surfaces.

SUMMARY OF THE INVENTION

The invention is a method for treating stainless steel that both cleans and passivates the stainless steel surface. Specifically, the invention is a method for cleaning and passivating a stainless steel surface comprising:

1) contacting the surface with 1545 ml/liter of an acid formulation comprising between about 1 and 60% acid component, about 1–15% surfactant, and between about 39 and 98% water;
2) maintaining contact to dislodge and remove residue from the surface;
3) continuing contact to complex free iron ions liberated from the surface to form an oxide film on the surface; and
4) continuing contact to precipitate the complexed ions into the oxide film.

The surfactant is selected from the group consisting of anionic, cationic, nonionic and zwitterionic surfactants to enhance cleaning performance.

DETAILED DESCRIPTION OF THE INVENTION

The method for treating stainless steel according to the present invention includes contacting a composition comprising an acid component and water to the stainless steel surface. The compositions treat the stainless steel surface by removing residue, formed on the stainless steel surface during use of the stainless steel surface (e.g., during pharmaceutical or semiconductor processing), from the surface, simultaneously complexing free iron ions liberated from the stainless steel surface and forming an oxide film on the stainless steel surface, and precipitating the complexed ions into the oxide film.

Compositions useful for the methods of the invention comprise between about 1 and 60% acid component, about 1–15% surfactant, and between about 39 and 98% water. Unless otherwise indicated, all amounts and percentages are weight/weight.

The surfactant is selected from the group consisting of anionic, cationic, nonionic and zwitterionic surfactants to enhance cleaning performance. Examples of such surfactants include but are riot limited to water-soluble salts or higher fatty acid monoglyceride monosulfates, such as the sodium salt of the monosulfated monoglyceride of hydrogenated coconut oil fatty acids, higher alkyl sulfates such as sodium lauryl sulfate, alkyl aryl sulfonates such as sodium dodecyl benzene sulfonate, higher alkyl sulfoacetates, higher fatty acid esters of 1,2 dihydroxy propane sulfonates, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosine, and the sodium, potassium, and ethanolamine salts of N-lauroyl, N-myristoyl, or N-palmitoyl sarcosine.

Additional examples are condensation products of ethylene oxide with various reactive hydrogen-containing compounds reactive therewith having long hydrophobic chains (e.g. aliphatic chains of about 12 to 20 carbon atoms), which condensation products ("ethoxamers") contain hydrophilic polyoxyethylene moieties, such as condensation products of poly (ethylene oxide) with fatty acids, fatty alcohols, fatty amides, polyhydric alcohols (e.g. sorbitan monostearate) and polypropyleneoxide (e.g. pluronic materials).

Miranol JEM, an amphocarboxylate surfactant available from Rhone-Poulenc, Cranbury, N.J., is a typically suitable surfactant.

Acid components suitable for the present invention include hydroxyacetic acid and citric acid. Phosphoric acid can also be used to passivate the surface by coprecipitating free iron ions as the corresponding phosphate salt. Acetic acid is not suitable for the method of the invention. Optionally, the compositions can include more than one acid component.

Water suitable for the present invention can be distilled water, soft water, or hard water.

Methods of the present invention for cleaning and passivating a stainless steel surface comprise:

1) contacting the surface with 1545 ml/liter of an acid formulation comprising between about 1 and 60% acid component, about 1–15% surfactant, and between about 39 and 98% water.;
2) maintaining contact to dislodge and remove residue from the surface;
3) continuing contact to complex free iron ions liberated from the surface to form an oxide film on the surface; and
4) continuing contact to precipitate the complexed ions into the oxide film.

According to the process of the invention, both cleansing and passivation are achieved within about 20–30 minutes of initial treatment. Preferably, the method comprises:

1) contacting the surface with 22–38 ml/liter of an acid formulation comprising between about 15 and 40% acid, about 1–15% surfactant, and between about 59 and 84% water;
2) maintaining contact to dislodge and remove residue from the surface;
3) continuing contact to complex free iron ions liberated from the surface to form an oxide film on the surface; and
4) continuing contact to precipitate the complexed ions into the oxide film.

In one preferred embodiment, the method comprises:

1) contacting the surface with 22–38 ml/liter of an acid formulation comprising between about 15 and 40% hydroxyacetic acid, about 1–15% surfactant, and between about 59 and 84% water;
2) maintaining contact to dislodge and remove residue from the surface;
3) continuing contact to complex free iron ions liberated from the surface to form an oxide film on the surface; and
4) continuing contact to precipitate the complexed ions; into the oxide film.

In another preferred embodiment, the method comprises 1) contacting the surface with 22–38 ml/liter of an acid formulation comprising between about 15 and 40% citric acid, about 1–15% surfactant, and between about 59 and 84% water;
2) maintaining contact to dislodge and remove residue from the surface;
3) continuing contact to complex free iron ions liberated from the surface to form an oxide film on the surface; and
4) continuing contact to precipitate the complexed ions into the oxide film.

In another embodiment, the acid is a phosphoric acid and the complexed ions form iron phosphate salts which precipitate into the film.

In one particular embodiment of the invention, materials such as pharmaceutical products present in stainless steel manufacturing vessels to be cleaned and passivated are removed from the vessel. While the bulk of the material to be removed readily flows from the stainless steel vessel, a residue film remains on the stainless steel surface.

Compositions used in the present invention are contacted with the film-coated surface in one or more of several ways. One way to contact the film-coated surface is by using a fixed spray-ball mechanism which showers the composition onto the film-coated surface such that all film-coated surfaces are contacted with the composition. Another way to contact the film-coated surface is by using a flexible spray-ball mechanism which, at various positions within the vessel, showers the composition onto the film-coated surface such that all film-coated surfaces are contacted with the composition. Another way is to fill the vessel such that all film-coated surfaces are contacted with the composition.

After contact is initiated, the film is dislodged and solubilized, dispersed, or emulsified into the composition and removed from the vessel. Free iron ions are liberated from the surface and form an oxide film on the surface. The complexed ions of iron are precipitated into the oxide film. The composition removed from the vessel is optionally discarded or recycled.

Using the method of the invention, stainless steel can be cleaned and passivated in one treatment. The method provides a passive protective film in addition to cleaning stainless steel surfaces.

Table 2 in Example 2 represents data obtained from studies evaluating the passivation properties obtained using methods of the invention. Corrosion rate, measured electrochemically in mils per year (MPY), is initially high, but rapidly drops and remains low after a passive film is formed. Subsequent exposure of these passivated electrodes to fresh solutions of the same formulation results in no rise in corrosion rate, due to the protective effect of the passive film previously formed. As the corrosion reaction is initiated the free iron ions liberated are complexed. An oxide film forms on the metal surface upon exposure to the acid component. The complexes readily precipitate and incorporate into the oxide film, enhancing the integrity of the oxide film.

EXAMPLE 1 (control)

Stainless steel 316 (*CRC Handbook of Chemistry and Physics*, 56th Edition, P. F-152, defines 316 stainless steel as containing a Co/Ni/Mo percentage of 16/10/1 or 18/14/3 percent respectively) electrodes were treated with a 34% nitric acid solution, a standard solution used for passivating stainless steel surfaces. A corrosion rate profile was generated by immersing the electrodes in a fresh diluted solution and monitoring the corrosion rate, as measured in mils per year. The profile showed initial corrosion for a short period of time, resulting in formation of a protective film, followed by an extended period of time showing virtually no additional corrosion.

EXAMPLE 2

Compositions having the following formulations were prepared by adding acid to water:

TABLE 1

| | Formulation | | |
|---|---|---|---|
| Ingredient | 1 | 2 | 3 |
| Acetic acid | 23.2% | — | — |
| Hydroxyacetic acid | — | 29.4% | — |
| Citric acid | — | — | 25.5% |
| Miranol JEM | 2.0 | 2.0 | 2.0 |
| Water | 74.8 | 68.6 | 72.5 |
| Total | 100% | 100% | 100% |

Each formulation was evaluated by diluting to a concentration of 31 ml/liter, immersing stainless steel 316 electrodes to the diluted formulation at 80° C., and continuing to monitor the corrosion rate, as measured in mils per year. Water alone was also evaluated. Table 2 shows the corrosion rate achieved using Formulations 1, 2, or 3 described in Table 1, or water.

TABLE 2

| | Corrosion rate | | | |
|---|---|---|---|---|
| Time | 1 | 2 | 3 | water |
| 1 minute | 0.0 | 4.0 | 1.0 | 0.05 |
| 2 minutes | 2.0 | 8.0 | 4.0 | 0.05 |
| 3 minutes | 2.0 | 2.0 | 8.0 | 0.05 |
| 4 minutes | 2.0 | 1.0 | 2.0 | 0.05 |
| 5 minutes | 2.0 | 1.0 | 1.0 | 0.05 |
| 10 minutes | 0.7 | 0.7 | 0.7 | 0.05 |
| 15 minutes | 0.5 | 0.5 | 0.5 | 0.05 |
| 30 minutes | 0.5 | 0.5 | 0.5 | 0.05 |
| 60 minutes | 0.3 | 0.3 | 0.3 | 0.05 |

The data demonstrate that exposure of stainless steel to certain acid formulations causes an initial corrosive effect, which results in a formation of a passive film, followed by a reduced rate of corrosion over time.

EXAMPLE 3

Cleaning and passivating a pharmaceutical fermentation vessel

Pharmaceutical product present in a stainless steel pharmaceutical fermentation vessel to be cleaned and passivated is removed from the vessel. After the bulk of product is removed, a residue film remains on the stainless steel surface. A diluted (31 ml/liter) composition of 29.4% hydroxyacetic acid and 70.6% water is sprayed onto the film-coated surface. The film is dislodged dispersed into the composition and removed from the vessel. Free iron ions are liberated from the surface and form an oxide film on the surface The complexed ions of iron are precipitated into the oxide film. The composition removed from the vessel is optionally discarded or recycled.

Within the first 20–30 minutes of contact between the film-coated surface and the acid and surfactant composition, a passive protective oxide film forms on the surface.

Using the method of the invention, stainless steel can be cleaned and passivated in one treatment. The method provides a passive protective film in addition to cleaning stainless steel surfaces.

What is claimed is:

1. A method for concurrently cleaning a residue from and passivating a stainless steel surface which includes iron and chromium ions, the method comprising:

(1) contacting the stainless steel surface with 15 to 45 ml per liter of water of an acid formulation which formulation comprises between about 1 and 60% of an hydroxyacetic acid component, between about 1 and 15% of a surfactant and between about 39 and 98% of water;

(2) maintaining said contact to dislodge and remove the residue and to liberate free iron ions and chromium ions from the stainless steel surface; and (3) continuing said contact to form a passive protective film on said surface comprising a portion of said iron ions in oxide form, said chromium ions in oxide form, and a portion of said iron ions complexed by said acid component;

whereby a surface clean of residue and substantially passive to further oxidation is provided.

2. The method of claim 1 wherein said surface is contacted with 22 to 38 ml per liter of water of said acid formulation, which formulation comprises between about 15 and 40% of said acid component, between about 1 and 15% of said surfactant and between about 59 and 84% of water.

3. A method of concurrently cleaning an organic residue from and passivating a stainless steel surface which includes iron and chromium, the method comprising:

dislodging and removing the residue from the stainless steel surface by immersing the surface in an acid solution which comprises from about 1% to about 60% acid;

liberating iron and chromium ions from the stainless steel surface by continuing to immerse the stainless steel surface in the acid solution;

simultaneously (1) complexing the liberated iron ions with the acid formulation, (ii) forming an oxide layer on the stainless steel surface from the liberated ions, and (iii) precipitating the complexed iron ions into the oxide layer forming a corrosion resistant film of complexed iron ions and oxides of iron and chromium.

4. The method as set forth in claim 3 wherein the acid solution includes a 15 to 45 ml of an acid formulation per liter of water, which acid formulation includes:

between about 1 and 60% of at least one of hydroxyacetic acid, citric acid, and phosphoric acid, between about 1 and 15% of a surfactant, and between 39 and 98% water.

5. A method of concurrently cleaning an organic residue from and passivating a stainless steel surface which includes iron and chromium, the method comprising:

dislodging and removing the residue from the stainless steel surface by immersing the surface in an acid solution wherein the acid solution includes 15 to 45 ml of an acid formulation per liter of water, which acid formulation includes:

between about 1 and 60% of at least one acid selected from the group consisting of hydroxyacetic acid, citric acid, and phosphoric acid, between 1 and 15% of a surfactant, and between 39 and 98% water;

liberating iron and chromium ions from the stainless steel surface by continuing to immerse the stainless steel surface in the acid solution;

simultaneously (i) complexing the liberated iron ions with the acid formulation, (ii) forming an oxide layer on the stainless steel surface from the liberated ions, and (iii) precipitating the complexed iron ions into the oxide layer forming a corrosion resistant film of complexed iron ions and oxides of iron and chromium.

6. The method as set forth in claim 5 wherein immersion in the acid solution is for a duration of less that 30 minutes, whereby the stainless steel surface is cleaned an passivated in less than 30 minutes.

7. A method of concurrently cleaning an organic residue from and passivating a stainless steel surface which includes iron and chromium, the method comprising:

dislodging and removing the residue from the stainless steel surface by immersing the surface in an acid solution wherein the acid solution includes 22 to 38 ml of an acid formulation per liter of water, which acid formulation includes:

between about 15 and 40% of at least one of hydroxyacetic acid and citric acid, between 1 and 15% of a surfactant, and between 59 and 84% water;

liberating iron and chromium ions from the stainless steel surface by continuing to immerse the stainless steel surface in the acid solution;

simultaneously (i) complexing the liberated iron ions with the acid formulation, (ii) forming an oxide layer on the stainless steel surface from the liberated ions, and (iii) precipitating the complexed iron ions into the oxide layer forming a corrosion resistant film of complexed iron ions and oxides of iron and chromium.

8. A method of concurrently cleaning a residue from and passivating a stainless steel surface which includes iron and chromium, the method consisting essentially of:

contacting the stainless steel surface with 15 to 45 ml per liter of water of an acid formulation which formulation consists essentially of between about 1 and 60% of an hydroxyacetic acid component, between about 1 and 15% of a surfactant and between about 39 and 98% of water;

maintaining said contact to dislodge and remove any residue and to liberate free iron ions and chromium ions from the stainless steel surface; and continuing said contact to form a passive protective film on said surface comprising a portion of said iron ions in oxide form, said chromium ions in oxide form, and a portion of said iron ions complexed by said acid component;

whereby a surface clean of residue and substantially passive to further oxidation is provided.

9. A method of concurrently cleaning an organic residue from and passivating a stainless steel surface which includes iron and chromium, the method consisting essentially of:

dislodging and removing the residue from the stainless steel surface by immersing the surface in an acid solution wherein the acid solution includes 22 to 38 ml of an acid formulation per liter of water, which acid formulation consists essentially of:

between about 15 and 40% of at least one of hydroxyacetic acid and citric acid, between 1 and 15% of a surfactant, and between 59 and 84% water;

liberating iron and chromium ions from the stainless steel surface by continuing to immerse the stainless steel surface in the acid solution;

simultaneously (i) complexing the liberated iron ions with the acid formulation, (ii) forming an oxide layer on the stainless steel surface from the liberated ions, and (iii) precipitating the complexed iron ions into the oxide layer forming a corrosion resistant film of complexed iron ions and oxides of iron and chromium.

* * * * *